United States Patent [19]

Cory et al.

[11] Patent Number: 4,559,658

[45] Date of Patent: Dec. 24, 1985

[54] POSITIONING ASSEMBLY FOR A FURNITURE PANEL OR LIKE COMPONENT

[76] Inventors: John H. Cory, 17961 N.W. 2 Pl., Miami, Fla. 33169; Ben H. Zuckerman, 1202 Granada Blvd., Coral Gables, Fla. 33134

[21] Appl. No.: 607,444

[22] Filed: May 7, 1984

[51] Int. Cl.[4] ..... A47C 19/02

[52] U.S. Cl. ..... 5/433; 74/89.22

[58] Field of Search ..... 312/312; 5/432, 433, 5/538, 550; 108/144, 147, 7, 9; 74/89.22, 89.2, 89.71

[56] References Cited

U.S. PATENT DOCUMENTS

| | | | |
|---|---|---|---|
| 142,733 | 9/1873 | Rosin | 108/7 |
| 280,776 | 7/1883 | Altheide | 108/9 |
| 2,650,093 | 8/1953 | Shields | 74/89.21 |
| 2,655,834 | 10/1953 | Pennington | 74/89.21 |
| 3,044,312 | 7/1962 | Hall et al. | 74/89.22 |
| 3,311,413 | 3/1967 | Martens | 297/410 |
| 3,500,692 | 3/1970 | Sangster et al. | 74/89.22 |
| 3,743,381 | 7/1973 | Moodie | 74/89.22 |

*Primary Examiner*—William E. Lyddane
*Assistant Examiner*—Joseph Falk
*Attorney, Agent, or Firm*—John Cyril Malloy

[57] ABSTRACT

A positioning assembly to be used with mechanized furniture for the purpose of raising and lowering furniture panels, as well as other components, wherein a slide element is reciprocally mounted within a sleeve structure so as to travel along the length thereof upon selective operation of a drive motor. A cable and pulley assembly is interconnected in driving relation between the drive motor and the slide element such that the slide element may be raised or lowered selectively upon reverse operation of the drive motor thereby causing raising or lowering, or other predetermined movement, of a predetermined panel or like component.

5 Claims, 7 Drawing Figures

POSITIONING ASSEMBLY FOR A FURNITURE PANEL OR LIKE COMPONENT

BACKGROUND OF THE INVENTION

1. Field of the Invention

A positioning assembly including a sleeve mounted slide element operatively engaging and at least partially supporting a furniture panel or like component for the purpose of positioning the panel between predetermined positions wherein reverse operation of a drive motor serves to selectively drive the slide element successively in opposite directions.

2. Description of the Prior Art

Mechanized furniture of varying designs and configuration is well known in the prior art. Typically, such structure incorporates the use of a drive mechanism such as a motor, balanced weights and/or biasing springs to drive a cable and pulley assembly which serves to perform the intended mechanized or automatic movement of components for portions of the overall furniture structure.

U.S. Pat. Nos. disclosing these type of structures include the patents to Padgett, U.S. Pat. No. 2,576,888; Riley, U.S. Pat. No. 2,875,012; Chapman, U.S. Pat. No. 3,065,037; Longmire, 3,650,591; and Cory, U.S. Pat. No. 3,761,152.

Accordingly, there is a need in the furniture and related industry for a positioning assembly which is adaptable for use in a variety of specific applications associated with the movement or positioning of furniture panels or like components. Such an assembly should be simple in design and construction and therefore reliable in operation and performance. The structural design and the components while reliable should not be such as to significantly add to the overall cost of the furniture. In addition, a preferred positioning assembly should be such as to be adaptable to other application related to the positioning of structural panels or the like not specifically related to the furniture industry.

SUMMARY OF THE INVENTION

The present invention is directed towards a positioning assembly specifically designed to position a panel on furniture such as a headboard portion of a conventional or waterbed frame. It should be noted however that the subject positioning assembly and its various components can readily be adapted to the selective positioning of other panels not necessarily associated with furniture structure and still fall within the scope of the present invention.

The subject positioning assembly includes a slide element reciprocally mounted and at least partially supported within a sleeve means such that the slide element reciprocally travels along the length of a channel integrally or otherwise formed along the length of the sleeve means.

Drive means are provided in the form of an electrically powered drive motor capable of being operated or driven in reverse directions and which is activated or controlled by switch means. The switch means may include a plurality of limit type switches disposed in interruptive position relative to the path of travel of the slide element and structured and disposed to limit the extent of travel in opposite directions. Such switch means also may include on/off and directional type switches manually activated and/or controlled and disposed on the exterior of the furniture, casing or the like which houses the primary working components of the positioning assembly.

A cable and pulley assembly is also disposed in driving interconnection between the drive motor and the slide element itself. Such cable and pulley assembly includes at least a first and a second cable segment each drivingly secured to a drive pulley directly attached in driven relation to the drive motor. Opposite ends or other portions of each cable segment is secured in driving relation to the slide element. The cable and pulley assembly further includes a first and a second pulley element disposed in spaced apart relation to one another and mounted on opposite sides of the drive motor and attached drive pulley. The first cable segment is interconnected to the drive pulley, first pulley element and the slide element on one side of the drive motor. Similarly, the second cable segment is interconnected to the drive pulley, second pulley element and slide element on an opposite side of the motor means. By virtue of this disposition, rotation of the motor means and the attached drive pulley causes concurrent movement and/or rotation of the first cable segment and first pulley element and the second cable segment and second pulley element respectively in opposite directions. This is true in that both the first cable segment and the second cable segment are both attached in driven relation to the drive pulley and in driving relation to the slide element but on opposite sides of the drive pulley. Mere reversal of direction of the drive of the motor means causes reversal of direction of travel of the slide element within the channel of the sleeve means.

Actual positioning of the panel structure is accomplished by a roller element being rotatably mounted on a free end of the slide element wherein the roller engages a designated, preferably interior, surface of the panel and because of the relative dispositions between the panel and the slide element, causes the panel to raise or lower depending upon the direction of travel of the slide element and the direction of rotation of the drive motor.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings, in which.

Like reference numerals refer to like parts throughout the several views of the drawings.

DETAILED DESCRIPTION OF THE PREFERRED EMBODIMENT

Figure 1:
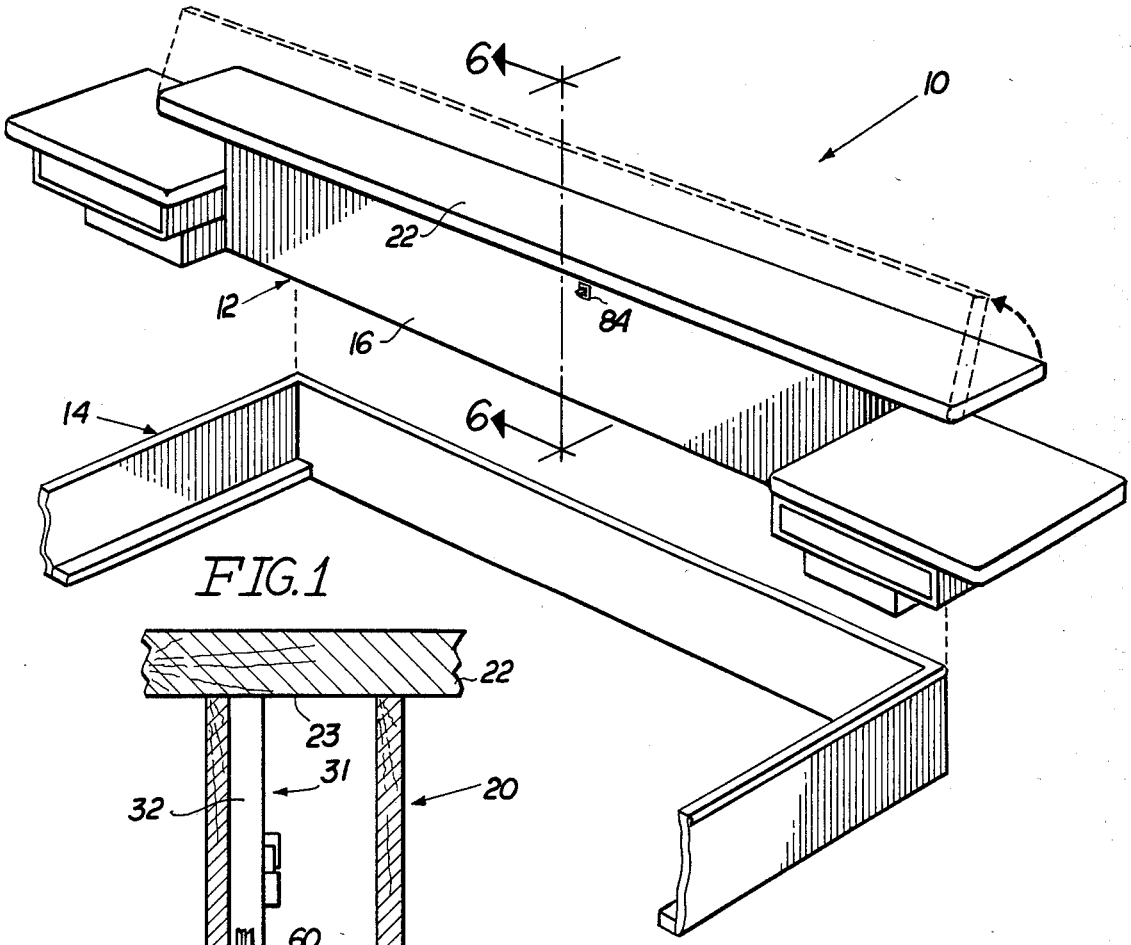
FIG. 1 is an isometric view in partial cutaway of the furniture incorporating the subject invention.
Figure 6:
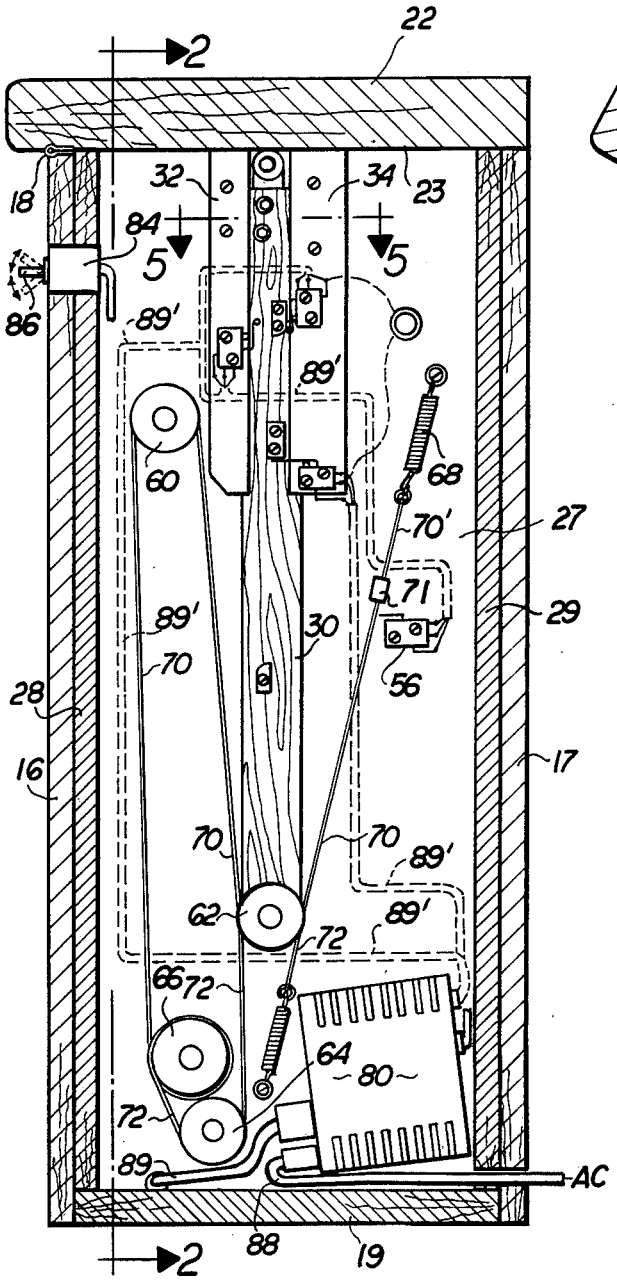
FIG. 6 is a sectional view along line 6—6 of FIG. 1 showing relative position and workings of the components of the positioning of the present invention.

As shown in FIG. 1, the present invention relates to a positioning or lift assembly primarily designed for use in lifting or positioning certain panels or components in furniture structure generally indicated as 10. More specifically, the furniture structure 10 includes a headboard 12 having a front face 16 wherein the entire structure is designed to be mounted on or positioned substantially adjacent the head of a bed frame 14. Frame 14 may be of conventional design or alternately may be structured to house a water mattress therein. The head portion 12 includes a panel member 22 which, in its normal position, is disposed in closed, overlying relation to the head portion or outer casing 16 (FIG. 6). However, the panel 22 is hingedly attached as at 18. The hinge 18 is of substantially conventional design and known in the art as a piano hinge, wherein the hinge 18 extends along a major portion of the length of the longitudinal edge thereof in interconnecting relation to the upper peripheral edge of the front wall of outer head casing 16.

With reference to FIGS. 2, 3, 4, 6 and 7, the present invention is directed towards a positioning assembly generally indicated as 20 and including an outer protective housing 24 having oppositely disposed, spaced apart side walls 25 and 26 respectively. The housing 24 is mounted on the interior of the furniture casing 16 and rests on a platform or base 19. The housing 24 has an open end disposed in direct communication with the undersurface 23 of the panel 22. In the embodiment shown in FIGS. 6 and 7, it should be noted that the panel 22 effectively serves as a cover or lid closing both the interior of the casing 16 and the interior 27 defined by side walls 25 and 26 and front and rear walls 28 and 29 respectively. Further, rear wall 17 of casing 16 may fit flush with the wall portion 29 of the housing wherein aperture means 21 is defined by aligned apertures in both the walls 29 and 17 so as to allow for exiting of AC conductor 88 interconnecting a power supply to control circuitry in circuitry casing 80.

Figure 2:
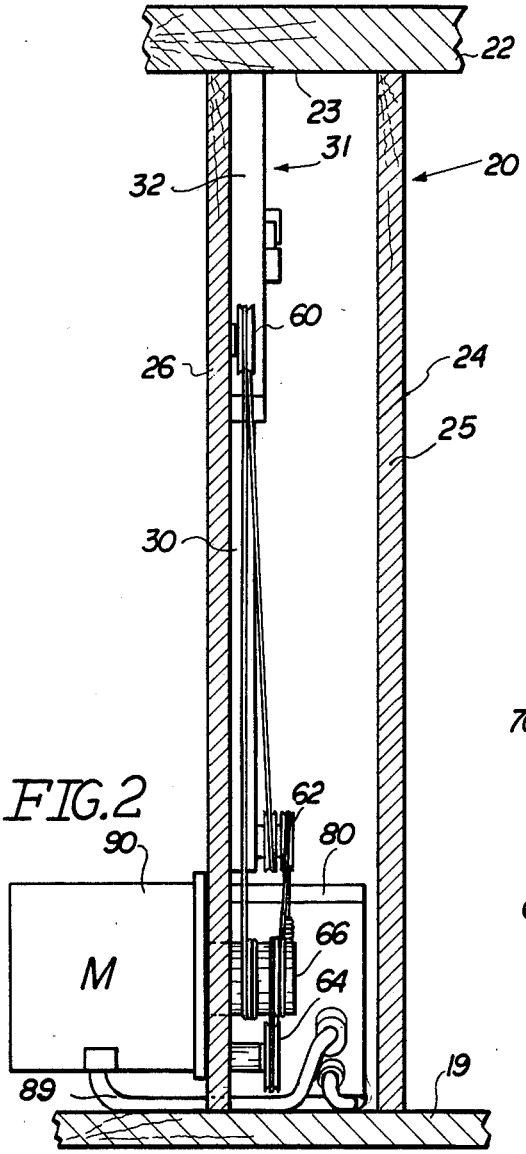
FIG. 2 is a sectional view taken along line 2—2 of FIG. 6 showing structural details and components of the subject positioning assembly.
Figure 3:
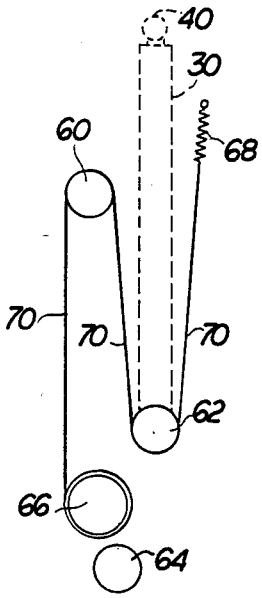
FIGS. 3 and 4 are schematic representations of the workings of the components of the present positioning assembly.
Figure 4:
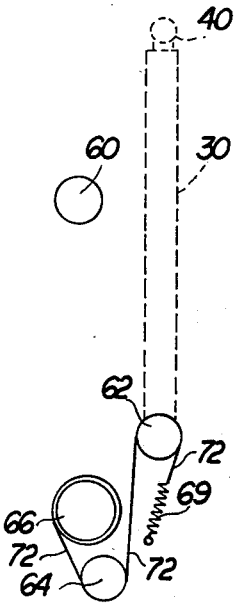
Figure 5:
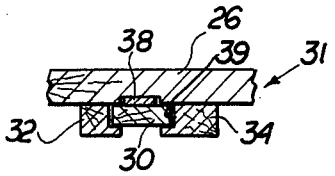
FIG. 5 is a sectional view along line 5—5 of FIG. 6.
Figure 7:
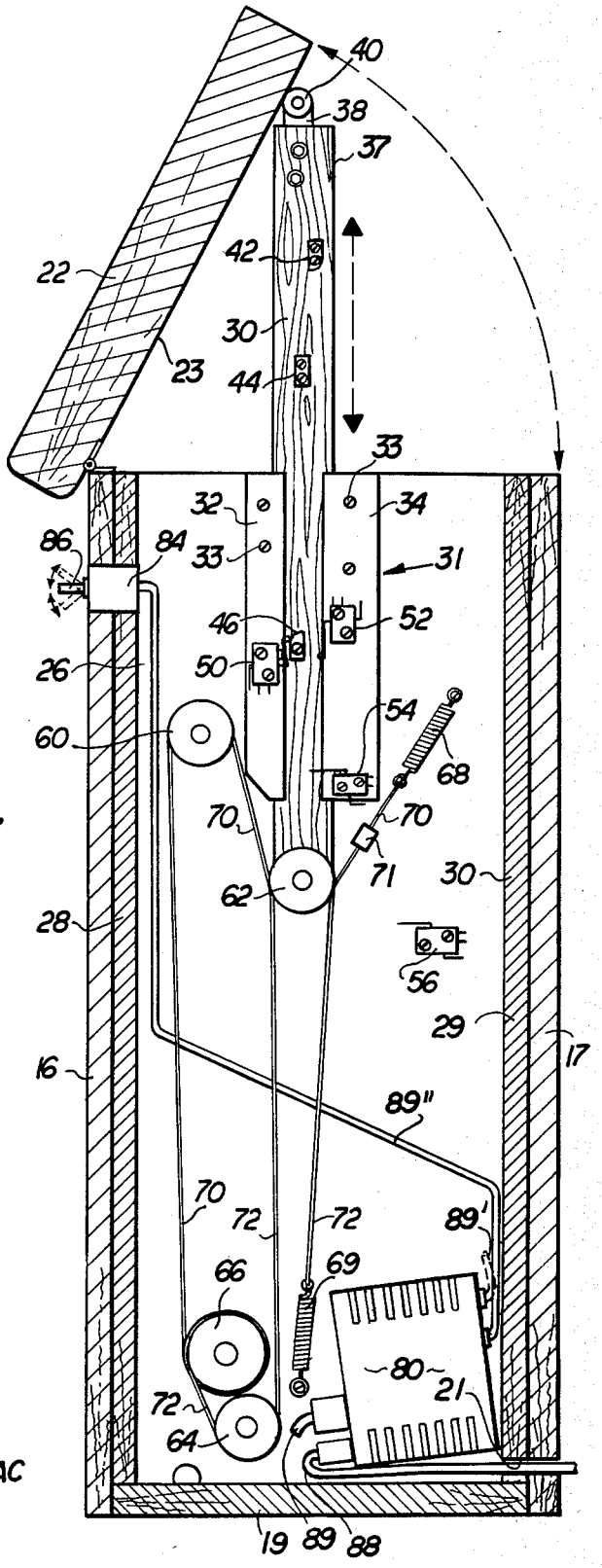
FIG. 7 is a sectional view with a slide member of the present invention shown in its operative, outwardly extended position.

The positioning assembly of the present invention includes a lift means including a slide element 30 reciprocally mounted on the interior 27 of the assembly housing 24. More specifically, the slide element 30 is disposed to travel within sleeve means generally indicated as 31 and defined by sleeve components 32 and 34 secured in at least partially overlapping relation to the slide element 30 by conventional connectors 33 or the like. This sleeve means 31 substantially defines a channel 39 on the interior thereof along which the slide element 30 travels (see FIG. 5). A free end as at 37 of slide element 30 includes roller means 40 disposed to extend outwardly therefrom by a supporting bracket 38. Roller means 40, as best shown in FIGS. 6 and 7, is disposed to movably engage the interior surface 23 of the lid panel 22. Therefore, upon upward movement of the slide element 30 (FIG. 7) the lid panel 22 pivots into its raised or extended position. In such position (FIG. 1) the panel 22 may serve as a backrest, headrest, or support for pillows or other objects. In that the slide element is reciprocally mounted within the sleeve means 31, downward movement of the slide element 30 into its reclined position again causes travel of the roller element 40 along the interior surface 23 of the panel 22 and the eventual placement of the lid panel 22 into its closed position as shown in FIGS. 1 and 2.

In order to accomplish selective reciprocal movement of slide element 30, the subject positioning assembly includes drive means comprising drive motor 90 secured to a directly driven drive pulley element 66.

The subject assembly further includes a cable and pulley assembly interconnected between the drive motor 90 and more particularly the drive pulley element 66 and the slide element 30. In that the drive motor 90 is capable of operation in reverse directions, the slide element may be selectively driven or moved between its stored position (FIG. 6) and its outwardly extended, operative position (FIG. 7) by merely reversing the direction of rotation of the drive motor 90 and accordingly direction of rotation of the drive pulley element 66.

With reference to FIGS. 2, 3, 6 and 7, the cable and pulley assembly of the present invention comprises a first cable segment 70 connected in driven relation to drive pulley element 66 and in driving relation to slide element 30 through a first pulley element 60 and a third pulley element 62, the latter of which is secured to travel with the slide element 30. The distal end as at 70' of the first cable segment 70 is secured to a spring means 68 which serves to absorb shock and provide for smooth performance and travel of the slide element 30. The cable and pulley assembly further includes a second cable segment 72 extending in driven relation from drive pulley element 66 about a second pulley element 64 and into driving relation or connection with third pulley element 62. It should be noted that third pulley element 62 is structured as a double pulley in that it is driven both by first and second cable segments 70 and 72 as disclosed in FIG. 2. Further, the distal end of second cable segment 72 as at 72' is interconnected to shock absorbing spring means 69 which is mounted on the interior 27 of the assembly housing and serves the same purpose as the shock absorbing spring means 68 with regard to the first pulley segment 70. While the first cable segment and first and third pulley elements 70, 60, and 62 respectively serve to drive the slide element 30 into its outward extended position, the second cable segment 72 and the associated second and third pulley elements 64 and 62 respectively serve to drive the slide element 30 into its retracted position (FIG. 6). As is disclosed in FIGS. 6 and 7, both the first cable segment 70 and the second cable segment 72 are both attached to the drive pulley element 66 and the third pulley element 62 attached to the slide element 30, therefore the direction of travel of the slide element 30 is dependent upon the direction of rotation of the drive pulley element 64 and of course the direction of rotation of the drive motor 90. The direction of travel of the slide element 30 is reversed merely by reversing the direction of travel of the motor 90 and attached drive pulley element 66. In that the first pulley element 60 and second pulley element 64 are located on opposite sides of the drive pulley element 66 along with their attached first and second cable segments 70 and 72 respectively, these pulleys 60 and 64 are concurrently rotating regardless of the direction of travel of drive pulley 66, but in opposite directions.

Control means of the present invention includes a switching assembly referred to above which includes an on/off and directional toggle switch 86 interconnected by switch conductor 89", AC line conductor 88 and motor conductor 89 through control circuitry casing 80 and into regulating relation to the drive motor 90. The direction of operation or rotation of the drive motor 90 is dependent upon the switch thrown or the direction of the toggle switch 86 which is manually positionable from the exterior of the headboard casing 16. Further, the switching means of the present invention includes limit type switches 50, 52 and 54 disposed adjacent the path of travel of the slide element 30 relative to the sleeve means 31 and further including lever type throw arms which are conventional in the prior art and which are disposed in interruptive relation to stop elements 46, 42 and 44 respectively. These switches are positioned to limit the distance traveled when the slide element moves outwardly into its extended operative position as shown in FIG. 7 and as well as into its retracted position as shown in FIG. 6. Further, conductor means 89' serves to interconnect the various limit switches with the control circuitry casing 80 and drive motor 90.

An auxiliary, limit switch 56 is also provided in operative position engagement for with a grommet means 71 which collectively serve as a safety device serving to discontinue power to the motor 90 if the lid panel 22 is blocked or encounters a heavy object. In such an event, the drive pulley element 66 continues to rotate causing rotation of roller 62 and extension of spring element 68. In that slide element is not moved upwardly due to blocking of lid panel 22, grommet means 71 secured to cable segment 70 will travel downwardly and spring 68 will continue to extend. Grommet means 71 will eventually engage and trip limit switch 56 and discontinue power to the motor 90.

It will thus be seen that the objects of the present invention made apparent from the preceding description are efficiently attained and since certain changes may be made in the above construction without departing from the scope of the invention, it is intended that all matter contained in the above description are shown in the accompanying drawings shall be interpreted as illustrative and not in a limiting sense.

Now that the invention has been described,

What is claimed is:

1. A positioning assembly of the type primarily designed for use in supporting and positioning a furniture panel or like structure, said positioning assembly comprising:

(a) lift means including at least one slide element having an elongated configuration an including free end disposed in movable, driving engagement with a furniture panel, (b) a drive assembly including a motor means drivingly interconnected to said one slide element and structured for selective reverse directional movement of said slide element along its own longitudinal axis, (c) a cable and pulley assembly movably disposed in driving interconnection between said motor means and said one slide element and structured for reciprical movement of said one slide element upon operation of said motor means in opposite directions, (d) said cable and pulley assembly comprising at least a first and a second cable segment each drivingly attached to said motor means and interconnected to said one slide element and further including at least a first and a second pulley element connected to said first and said second cable segment respectively intermediate said motor mean and said one slide element, (e) said first pulley element and said first cable segment and said second pulley element and said second cable segment respectively disposed on opposite sides of said motor means and further disposed for concurrent movement in opposite directions upon activation of said motor means, (f) said cable and pulley assembly further comprising a drive pulley element secured in direct driving attachment to said motor means and drivingly interconnecting said first cable segment thereto for concurrent and successive travel in opposite directions upon rotation of said motor means in opposite directions, (g) said third pulley element rotatably secured to said slide element in spaced relation to said free end, said third pulley element connected to both said first and said second cable segments for successive rotation in opposite directions upon rotation of said motor means in opposite directions, (h) switch means disposed adjacent a path of travel of said one slide element and in interruptive relation to said one slide element, (i) said switch means including at least a first and a second switch element disposed and structured for interruptive engagement with said slide element at spaced apart locations from one another and said respective switch elements further disposed and structured to limit the extent of travel of said one slide element in opposite directions, (j) a safety means for regulating operation of said motor means when lifting of the furniture is prevented, said safety means comprising a trip element secured to at least one of said cable segments so as to move therewith and an auxiliary switch assembly disposed in interruptive disposition relative to a path of travel of said trip element as it moves with said one cable segment, (k) said safety means further comprising said auxiliary limit switch electrically interconnected to said motor means so as to regulate current flow thereto, and a spring element attached to said one cable segment and disposed and structured for extension movement of said trip element into engagement with said auxiliary switch assembly when movement of said one slide element is prevented, said latter engagement causing a stopping of current flow to said motor means, (l) whereby positioning of the furniture panel is automatically operated and operation of said motor means is stopped upon prevention of opening of said panel.

2. An assembly as in claim 1 wherein said first pulley element and said first cable segment; and said second pulley element and said second cable segment are respectively disposed on opposite sides of said drive pulley element and structured to move concurrently in opposite directions upon rotation of said drive pulley element.

3. An assembly as in claim 1 wherein said free end of said one slide element includes a roller element secured thereto and movably positioned into engaging relation to a surface of the panel and said roller element being disposed to move along a portion of the furniture panel when moving the panel between a reclined and an extended position.

4. An assembly as in claim 1 wherein said lift means further comprises sleeve means fixedly secured relative to the panel and structured and dimensioned to slidingly receive said slide element therein, said slide element disposed and structured for reciprocal travel along at least a portion of the length thereof in a direction colinear to the longitudinal axis thereof, said sleeve means being structured to substantially define a path of travel of said slide element when in driving engagement with the furniture panel.

5. An assembly as in claim 4 wherein said first, second, third and driving pulley elements are relatively disposed and interconnected to at least one of said cable segments so as to cause selective reciprocal movement of said one slide element within said sleeve means upon reverse operation of said motor means.

* * * * *